US005999136A

United States Patent [19]

Winter et al.

[11] Patent Number: 5,999,136

[45] Date of Patent: Dec. 7, 1999

[54] USE OF ELECTRICALLY CONDUCTIVE CERAMIC PAINTS IN ANTENNA SYSTEMS

[75] Inventors: John A. Winter, Pittsburgh; Cheryl E. Belli, New Kensington; Vernon C. Benson, Jr., Arnold, all of Pa.

[73] Assignee: PPG Industries Ohio, Inc., Cleveland, Ohio

[21] Appl. No.: 09/130,564

[22] Filed: Aug. 7, 1998

[51] Int. Cl.[6] ..... H01Q 1/32

[52] U.S. Cl. ..... 343/713; 343/704; 343/906

[58] Field of Search ..... 343/713, 711, 343/712, 704, 906; 439/67, 916; H01Q 1/32

[56] References Cited

U.S. PATENT DOCUMENTS

| | | | |
|---|---|---|---|
| 3,655,545 | 4/1972 | Gillery et al. | 204/192 |
| 3,962,488 | 6/1976 | Gillery | 427/109 |
| 4,768,037 | 8/1988 | Inaba et al. | 343/713 |
| 4,849,766 | 7/1989 | Inaba et al. | 343/713 |
| 4,898,789 | 2/1990 | Finley | 428/623 |
| 4,992,801 | 2/1991 | Saito et al. | 343/713 |
| 5,083,134 | 1/1992 | Saitou et al. | 343/713 |
| 5,083,135 | 1/1992 | Nagy et al. | 343/713 |
| 5,346,933 | 9/1994 | Knell | 523/427 |
| 5,355,144 | 10/1994 | Walton et al. | 343/713 |
| 5,411,768 | 5/1995 | Knell et al. | 427/386 |
| 5,416,491 | 5/1995 | Nishikawa et al. | 343/713 |
| 5,528,314 | 6/1996 | Nagy et al. | 348/713 |
| 5,646,637 | 7/1997 | Miller | 343/713 |
| 5,648,758 | 7/1997 | Tweadey, II et al. | 340/550 |
| 5,670,966 | 9/1997 | Dishart et al. | 343/713 |
| 5,748,155 | 5/1998 | Kadunce et al. | 343/713 |

FOREIGN PATENT DOCUMENTS 1193150 9/1985 Canada .

*Primary Examiner*—Hoanganh Le

*Attorney, Agent, or Firm*—Kenneth J. Stachel; Andrew C. Siminerio

[57] ABSTRACT

The present invention provides for the use of electroconductive ceramic thermoplastic, thermoset and ultraviolet radiation curable paints as antenna elements and/or connector elements in a transparent antenna system. Antenna elements are formed on a major surface of a rigid transparent ply, preferably glass, and connected to a connector that permits transfer of signals generated by the antenna element to an electromagnetic energy transmitting and/or receiving device. The connector may be in direct electrical contact with or capacitively coupled to the antenna element. If desired, additional rigid transparent plies may be secured to the first ply to form a laminate, wherein the antenna element or the antenna element and the connector are laminated between the rigid plies.

19 Claims, 1 Drawing Sheet

USE OF ELECTRICALLY CONDUCTIVE CERAMIC PAINTS IN ANTENNA SYSTEMS

BACKGROUND OF THE INVENTION

1. Field of the Invention

The present invention relates to a vehicle antenna and in particular to the use of electroconductive ceramic thermoplastic, thermoset and ultraviolet radiation cured paints as antenna elements or connectors in an antenna system for a radio or other transmitting/receiving device.

2. Technical Considerations

In the past the traditional motor vehicle antenna for receiving and transmitting electromagnetic signals was a mast or whip-type antenna. Recently, there has been a trend towards incorporating the antenna into the vehicle structure. For example, U.S. Pat. Nos. 4,992,801 to Saito, et al.; 5,083,134 to Saitou, et al.; and 5,416,491 to Nishikawa, et al. disclose antennas wherein electrically conductive elements are printed on the surface of a glass window. U.S. Pat. Nos. 4,768,037 and 4,849,766 to Inaba, et al.; 5,355,144 to Walton, et al.; 5,528,314 to Nagy, et al. and 5,670,966 to Dishart, et al. disclose a transparent electroconductive coating over a substantial portion of a window, and in particular a vehicle windshield to form an antenna.

Electroconductive ceramic paint of the type generally used to form heating lines or antenna elements on the window surfaces of vehicles, includes silver particles, glass frit, flow modifying agents, pigments and an infrared radiation dried carrier (hereinafter referred to as "electroconductive ceramic IR paint"). Using this type of material, the antenna pattern is screen printed on the surface of a glass ply using techniques well known in the art and heated in an oven or furnace to dry the ceramic paint. Additional or prolonged heating is required to cure the paint and bond it to the glass. This same type of material may be used to provide an electrical connection to a transparent coating forming an antenna. Although the use of electroconductive ceramic IR paints provides acceptable results, one shortcoming of using this type of ceramic paint is that it remains wet for an extended period of time, i.e. generally until it is dried by an oven. As a result, processing time is lengthened. Furthermore, if additional paint patterns are to be screened over the previously coated surface, the first paint coating must be dried before the second paint coating is applied.

It would be advantageous to provide an antenna system that could easily be applied and processed without requiring additional processing operations after applying the antenna or connection material.

SUMMARY OF THE INVENTION

The present invention provides for the use of electroconductive ceramic thermoplastic, thermoset and ultraviolet radiation curable paints as antenna elements and/or connector elements in a transparent antenna system. Antenna elements are formed on a major surface of a rigid transparent ply, preferably glass, and connected to a connector that permits transfer of signals generated by the antenna element to an electromagnetic energy transmitting and/or receiving device. The connector may be in direct electrical contact with or capacitively coupled to the antenna element. If desired, additional rigid transparent plies may be secured to the first ply to form a laminate, wherein the antenna element or the antenna element and the connector are laminated between the rigid plies.

DETAILED DESCRIPTION OF THE INVENTION

The present invention provides an improved arrangement for fabricating and connecting to a glass antenna system. However, it should be appreciated that the present invention may be used in other types of electrical systems where reduced processing is desired.

Figure 1:
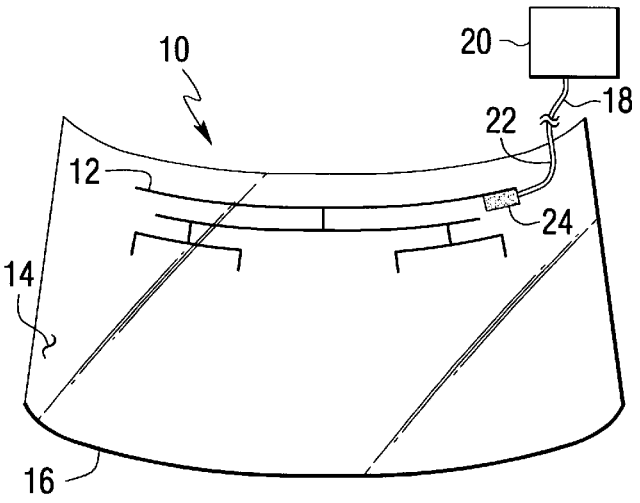
FIGS. 1 and 2 are plan views of transparent glass antenna arrangements incorporating features of the present invention.

FIG. 1 includes a glass antenna 10 of the type typically used in a motor vehicle. More specifically, antenna 10 includes an antenna pattern formed from a plurality of electroconductive elements 12 applied to major surface 14 of a glass ply 16. Although not required, surface 14 generally faces the inside of the vehicle. Ply 16 may also include a decorative border (not shown) bonded to the marginal edge portion of surface 14 of ply 16, as is well known to those skilled in the art. A feed line, for example a coaxial cable 18, provides a connection between the antenna 10 and an electromagnetic energy transmitting and/or receiving device 20, which may be a radio, cellular phone, television, computer, remote keyless entry, automatic toll collection system, global positioning system or other type of system that uses antenna 10 to transmit and/or receive signals. To connect the antenna 10 to cable 18, one end of a wire lead 22 is secured to the antenna 10, for example, by soldering. A terminal assembly (not shown), for example a reinforced spade assembly, a male Jaso pin, or other electrical connection device well known in the art, is connected to the opposing end of wire lead 22 so that the coaxial cable 18 may be electrically interconnected to the antenna 10. To facilitate connection of wire lead 22 to antenna 10 by soldering, one of the antenna elements 12 may include an enlarged connector patch 24. As an alternative to soldering a wire lead 22 directly to patch 24, a metal clip (not shown) of a type well known in the art may be secured to the connector pattern, and in particular to patch 24, with a wire or coaxial cable being secured to the metal clip. Furthermore, if desired, coaxial cable 18 may be secured directly to patch 24.

Typically, elements 12 and patch 24 of antenna 10 are an electroconductive ceramic IR paint that is screen printed on surface 14 of ply 16 and heated in an oven to dry the paint and allow further processing. If desired, the drying may be accomplished during subsequent heating and shaping of the glass ply 16. However, care must be taken in handling the glass ply until it has been processed in a manner that dries the electroconductive paint so as to avoid any smearing or other marking of the pattern that will adversely affect the performance of the antenna 10. In addition, if an additional screen printed pattern must be applied to surface 14 and/or over the antenna pattern, ply 16 must be processed in a way that will dry the electroconductive ceramic IR paint before any further processing.

The present invention provides a material that eliminates the need to dry the paint by extended waiting periods or by heating the glass in an oven or furnace. More specifically, the antenna pattern in the present invention is formed using an electroconductive ceramic paint that includes silver particles, glass frit, flow modifying agents and pigment combined with a thermoplastic carrier, such as but not limited to fatty alcohols, or a thermoset carrier (hereinafter referred to as "electroconductive ceramic thermoplastic paint" and "electroconductive ceramic thermoset paint", respectively). Paints which use a thermoplastic or thermoset carrier are often referred to as "hot melt paints" and as used hereinafter, the electroconductive ceramic thermoplastic and thermoset paints of the instant invention are collectively referred to as "electroconductive ceramic hot melt paints". Nonelectroconductive hot melt paints have been used in the can and bottling industry to mark the outer surface of containers and nonelectrically conductive thermoplastic/thermosettable coatings for glass are disclosed in U.S. Pat. Nos. 5,346,933 to Knell and 5,411,768 to Knell, et al. Electroconductive ceramic thermoplastic paint has been used to form resistive heating line elements on a rear window of a vehicle as disclosed in Canadian Patent No. 1,193,150. In the instant invention, an electroconductive ceramic hot melt paint is applied along surface 14 of ply 16 in the desired antenna pattern using a screen printing process, as is well known in the art, which incorporates a heated metal screen that melts the paint and maintains it in liquid form. During the screen printing operation, when the hot paint contacts the cooler glass, the paint sets, i.e. it may immediately be contacted without adversely affecting the screened pattern. It should be appreciated that although the paint may appear to be dry, it still must be heated to cure and bond the paint to the glass surface, as with a electroconductive ceramic IR paint.

Although not limiting in the present invention, it is preferred that the electroconductive ceramic hot melt paint include at least about 70% by weight silver and up to about 10% by weight frit. Using electroconductive ceramic hot melt paints as disclosed herein provides an advantage over electroconductive ceramic IR paints in that since the former paint sets immediately, the glass ply may be handled without fear of smudging the antenna pattern formed by the elements 12. Furthermore, additional materials may be screened directly over the previously screened pattern without first having to heat the glass to dry the screened antenna pattern.

As an alternative to using electroconductive ceramic hot melt paint, the antenna pattern may be formed using an electroconductive ceramic paint which includes silver particles, flow modifiers and pigment and incorporates an ultraviolet radiation cured carrier (hereinafter referred to as "electroconductive ceramic UV paint"). The electroconductive ceramic UV paint is set by exposing it to ultraviolet light. As discussed above re: electroconductive ceramic hot melt paint, although the electroconductive ceramic UV paint may be dry to the touch, it still must be heated to cure and bond the paint to the glass surface. The use of electroconductive ceramic UV paint provides the same advantages as the electroconductive ceramic hot melt paint.

When the electroconductive ceramic hot melt and UV paints of the instant invention are used to form the antenna elements 12 or connector patch 24 of the type shown in FIG. 1, it is preferred that the paint have a resistivity of less than about 25 ohms per square, and preferably less than about 0.1 ohms per square.

Figure 2:
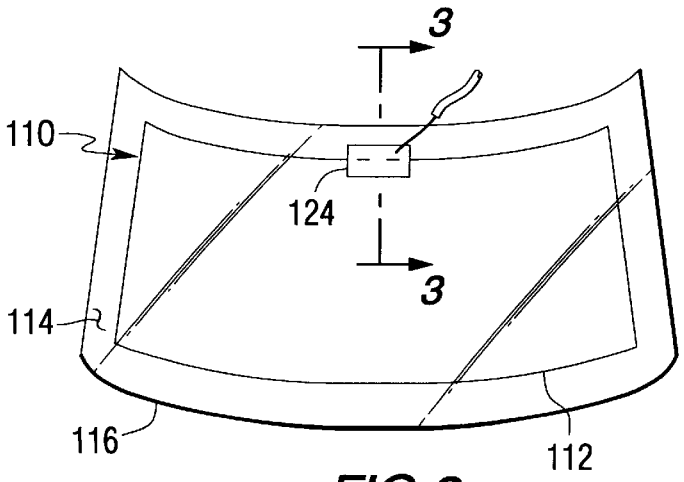

The electroconductive ceramic hot melt and UV paints disclosed herein may also be used as a connector to an antenna system which incorporates antenna elements made from other types of materials. For example, referring to FIGS. 2 and 3, a glass ply 116 includes a transparent electroconductive coating 112 at least in close proximity to surface 114 of ply 116, and preferably along surface 114, to form an antenna 110. As an alternative, the electroconductive coating may be first applied to or be incorporated within a flexible layer (not shown), e.g. polyvinylbutyral or polyester, which is then adhered to surface 114 of ply 116. Although not required, in the particular antenna configuration illustrated in FIGS. 2 and 3, coating 112 generally occupies the central portion of ply 116 and is spaced from the peripheral edge of ply 116. Other antenna coating patterns are disclosed in U.S. Pat. Nos. 5,083,135; 5,528,314; and 5,648,758 to Nagy, et al. The coating 112 may be a single or multilayered metal-containing coating, such as but not limited to those disclosed in U.S. Pat. Nos. 3,655,545 to Gillery, et al.; 3,962,488 to Gillery and 4,898,789 to Finley. As was discussed earlier with respect to FIG. 1, ply 116 may further include a decorative border (not shown) bonded to the marginal edge portion of surface 114 of ply 116. Connector 124 in the form of an electroconductive ceramic hot melt or UV paint is applied to ply 116 in any convenient manner know in the art such that connector 124 is in direct electrical contact with coating 112. This may be accomplished by screen printing at least a portion of connector 124 over a selected portion of coating 112 as shown in FIG. 2, or the connector 124 may simply contact the coating 112 along a selected coating edge. In addition, if desired, the entire connector 124 may be positioned on the coating 112. A wire lead, cable and/or clip may be secured to the connector 124 in a manner as discussed earlier.

Figure 4:
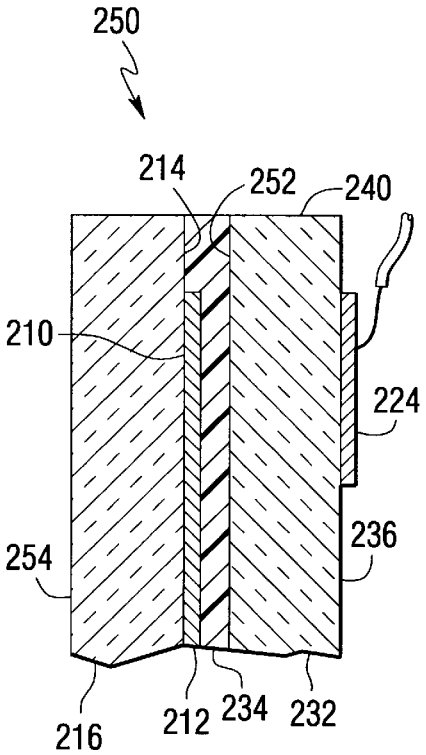
FIG. 4 is a view similar to FIG. 3 of an alternate antenna arrangement incorporating features of the present invention, with portions removed for clarity.

It should be appreciated that the electroconductive ceramic hot melt or UV paint of the instant invention may also be used to make a capacitive type connection to an antenna system. More specifically, referring to FIG. 4, an antenna 210 is incorporated into a laminate, and in particular a laminated windshield 250. Antenna 210 is formed by a transparent electroconductive coating 212 that is positioned at least in close proximity to surface 214 of outer glass ply 216, and preferably along surface 214, in a desired pattern as discussed above. An inner glass ply 232 is bonded to ply 216 by a thermoplastic interlayer 234, preferably polyvinylbutyral. In this manner the antenna 210 is sealed between the two plies. The embodiment of the invention illustrated in FIG. 4 shows the coating 212 applied to surface 214 of ply 216; however, it should be appreciated that as an alternative the electroconductive coating may be first applied to the interlayer 234 or incorporated into the interlayer 234, as discussed earlier, which is then positioned between the plies 216 and 232 to form the laminate. In this particular embodiment of the invention, a connector 224 is formed from an electroconductive ceramic hot melt or UV paint of the type taught herein and is positioned such that it is not between plies 216 and 232. More specifically, the connector 224 is applied to an exposed surface of the windshield 250, and in particular surface 236 of inner glass ply 232 so that it is spaced from the coating 212 by an inner ply 232 and interlayer 234 and overlays a selected portion of the coating 212. In this manner, the connector 224 is capacitively coupled to the antenna 210. It should be appreciated that connector 224 could also be capacitively coupled to coating 212 by positioning connector 224 in surface 252 of inner ply 232 or surface 254 of outer ply 216.

The size of the connector 124, 224 will depend on whether it is directly connected or capacitively coupled to the antenna. Generally, a direct connection requires a smaller connection than a capacitive connection. If the connector is too large, depending on its location, it may impair the visibility of the vehicle operator. For example, connector 224 in FIG. 4 is a capacitive-type connection positioned along the top edge 240 of the windshield 250. A large connector may impair the driver's vision; for example, when viewing a traffic signal. To address this concern, the connector 224 may be designed to provide a desired visibility therethrough. More specifically, the connector 224 may be formed into a grid-like or other pattern (not shown) having a plurality of spaced apart, interconnected elements using the electroconductive ceramic hot melt or UV paints of the instant invention. The elements are arranged so that the vehicle operator has a desired amount of visibility through the connector.

Figure 3:
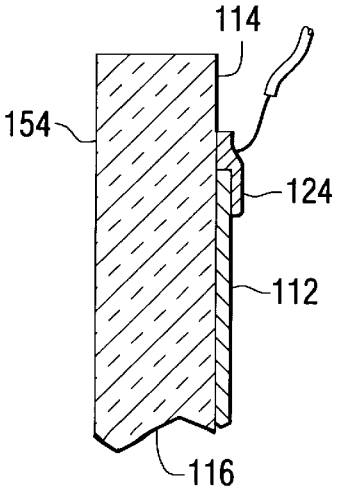
FIG. 3 is a sectional view taken along line 3—3 in FIG. 2, with portions removed for clarity.

When the electroconductive ceramic hot melt or UV paints of the instant invention is used to form a direct electrical contact connector of the type shown in FIGS. 2 and 3 or a capacitive-type connector as shown in FIG. 4, it is preferred that the resistivity of the paint be not greater than the resistivity of the antenna element to which it is connected and preferably less than about 0.1 ohms per square.

It should be appreciated that although FIGS. 2 and 3 illustrate an antenna arrangement with a direct electrical connection between connector 124 and coating 112, as an alternative connector 124 may be positioned along surface 154 of ply 116 in a manner as discussed above or along surface 114 but spaced from coating 112 to establish a capacitive connection with the coating 112. Similarly, although FIG. 4 illustrates an antenna arrangement with a capacitive connection between connector 224 and coating 212, the connector 224 may be positioned along surface 214 of outer ply 216 to establish a direct electrical connection between the connector 224 and coating 212.

In one particular embodiment of the invention, an antenna arrangement similar to that shown in FIG. 4 and which incorporates a connector 224 as disclosed herein, includes an antenna element formed from a transparent electroconductive coating having a resistivity of approximately 3 ohms per square. The connector 224 is a grid-like pattern, i.e. includes a plurality of interconnected straight line elements formed from an electroconductive ceramic thermoplastic paint produced by Cerdec Corporation, Washington, Penna., and identified as CCLO62 thermoplastic silver paint which includes about 76 percent silver powder and about 2 percent borosilicate glass frit, with the remainder being pigment, acrylic resin (flow modifier) and 1-octadecanol (thermoplastic carrier). This particular paint has a melting point temperature of about 150° F. (66° C.) and a viscosity of about 10,000 centipoise measured using a Brookfield cone and plate viscometer at 200° F. (93° C.), and provides a resistivity of about 0.035 ohms per square. This paint formulation has also been used to form an antenna pattern as discussed earlier in connection with FIG. 1.

In configuring a capacitive type connector with the electroconductive ceramic hot melt or UV paint of the present invention as discussed above, since the connector elements are electroconductive, care should be taken to ensure that the connector does not act as an antenna element that interferes with the principle antenna elements. However, if desired, the connector may be designed such that a first portion of the connector is capacitively coupled to the principle antenna element while other portions of the connector are configured to function as additional antenna elements for frequencies outside those transmitted or received by the principle antenna. Furthermore, if desired the first portion may be configured to also function as an antenna element.

The invention described and illustrated herein represents a description of illustrative preferred embodiments thereof. It is understood that various changes may be made without departing from the gist of the invention defined in the following claims.

We claim:

1. In a transparent antenna arrangement having an electroconductive antenna element positioned at least in close proximity to a major surface of a rigid transparent substrate and a connector secured to said substrate to permit transfer of signals generated by said antenna element to an electromagnetic energy transmitting and/or receiving device, the improvement comprising;

selected portions of said antenna arrangement being formed from an electroconductive ceramic paint selected from the group consisting of electroconductive ceramic thermoplastic paints, electroconductive ceramic thermoset paints, and electroconductive ceramic UV paints.

2. The antenna as in claim 1 wherein said rigid substrate is a glass ply and said selected portions of said antenna arrangement include said antenna element.

3. The antenna as in claim 1 wherein said rigid substrate is a glass ply and said selected portions of said antenna arrangement include said connector.

4. The antenna as in claim 3 wherein said connector is in direct electrical contact with said antenna element.

5. The antenna as in claim 3 wherein said connector is capacitively coupled to said antenna element.

6. The antenna as in claim 3 wherein said glass ply is a first glass ply and further including a second glass ply secured to said first ply to form a laminate such that said antenna element is positioned between said first and second glass plies.

7. The antenna as in claim 6 wherein said antenna element is a transparent electroconductive coating and said connector is positioned on an exposed major surface of said laminate such that at least a portion of said connector overlays a portion of said coating and is capacitively coupled to said antenna element.

8. The antenna as in claim 7 wherein said paint has a resistivity of no greater than 0.1 ohms per square and includes at least about 70 weight percent silver and up to about 10 weight percent frit.

9. The antenna as in claim 1 wherein said paint has a resistivity of no greater than 25 ohms per square.

10. The antenna as in claim 9 wherein said paint has a resistivity of no greater than 0.1 ohms per square.

11. The antenna as in claim 1 wherein said paint includes at least about 70 weight percent silver and up to about 10 weight percent frit.

12. In a method of making a transparent antenna arrangement including the steps of positioning an electroconductive antenna element at least in close proximity to a major surface of a rigid transparent ply and positioning an electroconductive connector relative said ply such that said connector is electrically connected to said antenna element to permit transfer of signals generated by said antenna element to an electromagnetic energy transmitting and/or receiving device, the improvement comprising:

forming selected portions of said antenna arrangement from an electroconductive ceramic paint selected from the group consisting of electroconductive ceramic thermoplastic paints, electroconductive ceramic thermoset paints and electroconductive ceramic UV paints.

13. The method as in claim 12 wherein said rigid ply is a glass ply and said forming step includes the step of forming said antenna element on a major surface of said glass ply from said paint.

14. The method as in claim 12 wherein said rigid ply is a glass ply and said forming step includes the step of forming said connector on a major surface of said glass ply from said paint.

15. The method as in claim 14 wherein said antenna element positioning step includes the step of applying a transparent electroconductive coating along said major surface of said glass ply and said connector positioning step includes the step of positioning said connector on said major surface such that said connector is in direct electrical contact with said coating.

16. The method as in claim 14 wherein said antenna element positioning step includes the step of applying a transparent electroconductive coating along said major surface of said glass ply and said connector positioning step includes the step of positioning said connector in spaced apart relation from said coating such that said connector is capacitively coupled to said antenna element.

17. The method as in claim 16 further including the step of securing a second glass ply to said first glass ply to form a laminate such that said antenna element is between said first and second plies, and said connector positioning step includes the step of applying said connector to an exposed major surface of said laminate such that at least a portion of said connector overlays a portion of said coating and is capacitively coupled to said antenna element.

18. The method as in claim 12 wherein said connector positioning step includes the step of positioning said connector such that said connector is in direct electrical contact with said antenna element.

19. The method as in claim 12 wherein said connector positioning step includes the step of positioning said connector such that said connector is capacitively coupled to said antenna element.

* * * * *